US005800651A

United States Patent [19]

Williamson

[11] Patent Number: 5,800,651

[45] Date of Patent: Sep. 1, 1998

[54] PROCESS FOR MANUFACTURING A GLASS REINFORCED PLASTIC DOOR PANEL

[75] Inventor: Gerald F. Williamson, Laramie, Wyo.

[73] Assignee: Smartdoor Fiberglass Systems, Inc., Laramie, Wyo.

[21] Appl. No.: 816,924

[22] Filed: Mar. 13, 1997

Related U.S. Application Data

[62] Division of Ser. No. 607,224, Feb. 26, 1996, Pat. No. 5,653,075.

[51] Int. Cl.[6] ..... E04C 2/30

[52] U.S. Cl. ..... 156/180; 156/267; 156/269; 156/433; 156/441; 264/134; 264/148

[58] Field of Search ..... 156/166, 180, 156/245, 242, 433, 441, 267, 250, 269; 264/145, 148, 134, 137

[56] References Cited

U.S. PATENT DOCUMENTS

| | | | |
|---|---|---|---|
| 4,374,693 | 2/1983 | Pitt | 156/267 |
| 4,676,041 | 6/1987 | Ford | 52/309.11 |
| 4,752,513 | 6/1988 | Rau et al. | 428/91 |
| 5,448,869 | 9/1995 | Unruh et al. | 52/656.1 |
| 5,687,532 | 11/1997 | Torrey | 52/656.3 |

FOREIGN PATENT DOCUMENTS

| | | |
|---|---|---|
| 2276186 | 9/1994 | United Kingdom . |

*Primary Examiner*—Jeff H. Aftergut
*Attorney, Agent, or Firm*—Roland H. Shubert

[57] ABSTRACT

A method is provided for pultruding a glass reinforced plastic door panel that is field alterable to fit an out-of-true frame. A mixture of reinforcing fibers and resin is pulled through a set of dies to form a panel having a pair of face sheets that are spaced apart by a hinge side stile at one panel edge and a strike, or lock, side stile at the other panel edge. The hinge side stile is arranged perpendicularly to the face sheets to form a closed panel edge, and the strike side stile is formed as a thick-walled structural channel open to the panel side. The pultruded panel is thereafter cut to lengths equal to the desired height of a door panel.

6 Claims, 2 Drawing Sheets

PROCESS FOR MANUFACTURING A GLASS REINFORCED PLASTIC DOOR PANEL

This application is a division of prior application Ser. No. 08/607,224, filed on Feb. 26, 1996, now U.S. Pat. No. 5,653,075, entitled "FIELD ALTERABLE, GLASS REINFORCED PLASTIC DOOR PANEL."

TECHNICAL FIELD

This invention relates generally to field alterable door panels made of fiber reinforced plastic, and to methods for their manufacture.

More specifically, this invention relates to a fiberglass door panel that can be altered at the installation site to fit the frame opening, and to its manufacture by pultrusion techniques.

BACKGROUND ART

Many door panels in use today utilize fiberglass reinforced plastics to form part or all of the door panels. Fiberglass reinforced plastics are also referred to as FRP, as fiberglass, as glass reinforced plastics, as GRP, and as reinforced polymer composites. All of these various terms are synonymous and, for the purposes of this application, refer to the same material, system and will be used interchangeably. Ordinarily, doors constructed of fiberglass reinforced plastics have a pair of spaced stiles that form the door edges, a top and a bottom rail, and a pair of skin members that form the door faces. Such doors are commonly referred to as being of composite construction. A core material such as foamed plastic often is used to fill the interior void space so as to increase the rigidity of the door and to provide insulation. The hinge side stile must be of sufficient width and strength to receive and support the door mounting hinges. Likewise, the lock, or strike side stile must be able to receive and support a door latching and locking mechanism that extends out from the edge of the door to engage a recess in the door frame.

There are currently no trade-accepted descriptions or definitions of the features that make up a "fiberglass door." Several different types of door panels are commonly described in the market place as being that. Included within those common market place descriptions are first, door panels that have a sub-structure made from a structural material such as steel, wood, or aluminum, and have bonded to that sub-structure a pair of face sheets or panels constructed of fiber reinforced resin. Another type of door panel that is commonly called a fiberglass door is one that has an all fiberglass internal and external composition, but that also relies on one or more non-fiberglass internal structural members to provide for a required performance trait.

A specific example of a composite door of the first type found in the patent literature is U.S. Pat. No. 5,239,799 to Bies et al. This patent describes a door having a pair of stiles that form the side edges of the door, a top rail extending between the stiles, and a pair of door facing skins that are molded from fiber reinforced resin. The skins are adhesively bonded to the stiles and the top rail, and have edge flanges which abut to form the top and bottom edges of the doors. A foamed plastic such as polyurethane is injected into the interior void space formed between the stiles, the top rail and the bottom flanges. A door construction generally similar to that described in the Bies et al patent is disclosed in U.S. Pat. No. 5,074,087. It shows a door of composite construction, having an internal door frame formed of a pair of stiles and top and bottom rails, with a pair of molded fiberglass skins bonded to the frame. Another example is that of the Thorn patent, U.S. Pat. No. 4,922,674. That patent shows a door that does not use either side stiles or top and bottom rails. Rather, the door is constructed of a pair of molded fiberglass panels that fit together to form a sandwich. Reinforcing mounting blocks are provided at the hinge and lock locations, and a preformed core of foamed plastic or other insulating material is inserted into the cavity formed between the panels.

Yet another type of door panel commonly referred to as a fiberglass door has an all fiberglass internal and external composition, with no other material systems used to provide structural support. That mode of construction is illustrated by U.S. Pat. No. 4,068,431, issued to William Pitt. The Pitt patent describes a door which uses a single-piece, stile and rail frame or collar constructed of fiberglass reinforced resin. Both style and rail portions of the collar display an inwardly opening, U-shaped configuration with the base, or bight, portion of the collar forming the door edge.

When a door panel is manufactured, the dimensions of the door panel are set by its maker to fit a frame opening of a specific size. The dimensions of the frame opening, in turn, ordinarily conform to the standards set by the door industry. A door panel, fabricated to fit a specific frame opening, will function with complete satisfaction provided that the dimensions of the frame remain constant, that the dimensions and geometry of the door panel remain constant, and that the alignment of the frame remains true. Problems arise in installing door panels within their frames when either the dimensions or the alignment of the frame go out of specification.

Out of specification conditions can arise from a number of different causes. For example, a building might shift or settle, and the wall in which the frame is set forces the frame out of square and alignment. In a masonry building, if the opening set by the mason is not square and plumb and if the frame installer uses the wall as a template, the frame opening will not fit the door panel. Over a period of time, a door frame may be subjected to torquing from traffic abuse sufficient to cause the frame opening to come out of square and plumb. Metal frames may corrode over time to the point where lower extremities of the jamb are pushed out of alignment, and the opening becomes narrower at the bottom than at the top. The installed door then binds on various parts of the frame.

There are many instances where it is not practical, or even possible, to modify a door frame that is out of dimensional specification. In those instances, it is the door panel that must be altered to make it fit the frame opening. Modification of the door panel requires that a stile or rail of the door be cut or shaped to conform with the frame opening. A wood door typically is constructed with rather wide stiles and rails that can be cut or shaped to fit the a particular frame opening without structurally weakening the door panel, and without undue change to its appearance. A steel door presents a more complex situation, but a skilled installer can cut an edge, side or top, and weld back a modified edge plate. Some patio and storm doors are provided with an adjustable sleeve on one or both of the stiles that can arranged to provide an acceptable fit with the frame. A variety of accessories are also offered by a number of different manufacturers to cover, extend, patch and modify the stiles of steel doors. In most instances, however, it is very obvious that the panel has been modified.

To this time, the fabricators of doors constructed entirely of fiber reinforced plastic, or fiberglass, have offered only door panels that have fixed and unalterable stiles. One important reason for that circumstance is that a feature offered by most manufacturers is that the door as shipped by the factory has an interior cavity that is completely sealed off from exterior contamination. The fact that the structural integrity of the door is largely dependent upon a seamless bond between the structural frame components of the door and the face sheets allows, almost by default, for that feature to be offered at no additional expense to the buyer. Because the stiles of a fiberglass door are essential to the structural soundness of the panel, any field alteration of the door's dimensions can result in breaking of the seal to the interior cavity and weakening of the door. In most instances, any field alteration of the door will void the manufacturer's performance warranty as well. Further, it is not technically feasible or cost effective to provide a wide, solid stile, as in a wood door, to allow for the door to be field altered.

SUMMARY OF THE INVENTION

This invention comprises a fiber reinforced plastic door panel that is field alterable to fit a door frame by shaping the strike, or lock, side door stile without compromising the structural integrity of the panel. The panel includes a pair of panel face sheets, a hinge side stile, and a thick-walled, open-sided channel on the strike edge of the door panel, and running the full length of the panel. An open-ended interior cavity is formed by the panel face sheets, the hinge side stile, and the base of the open-sided channel. A flexible cap strip that is configured to fit within the open channel side and to provide a finished door edge is fitted within the channel after field modification of the door is complete. Top and bottom cap strips may also be provided to seal the door panel ends. The cavity may be left empty or it may be filled with a thermal and sound insulating material, such as foamed plastic, or with a fire resistant material such as a foamed cement. The door panels may be manufactured by pultrusion techniques wherein a continuous length of door paneling is cut to lengths equal to the desired height of the finished door.

Hence, it is an object of this invention to provide a fiber reinforced plastic door panel that can be field alterable to fit an out-of-specification frame.

It is another object of this invention to provide a method for manufacturing continuous lengths of door paneling that can be cut to obtain individual door panels of a desired height.

Yet another object of this invention is to provide a method and means for the field alteration of an all-fiberglass door panel to make it fit a frame that is out of square and alignment.

DESCRIPTION OF PREFERRED EMBODIMENTS OF THE INVENTION

Figure 1:
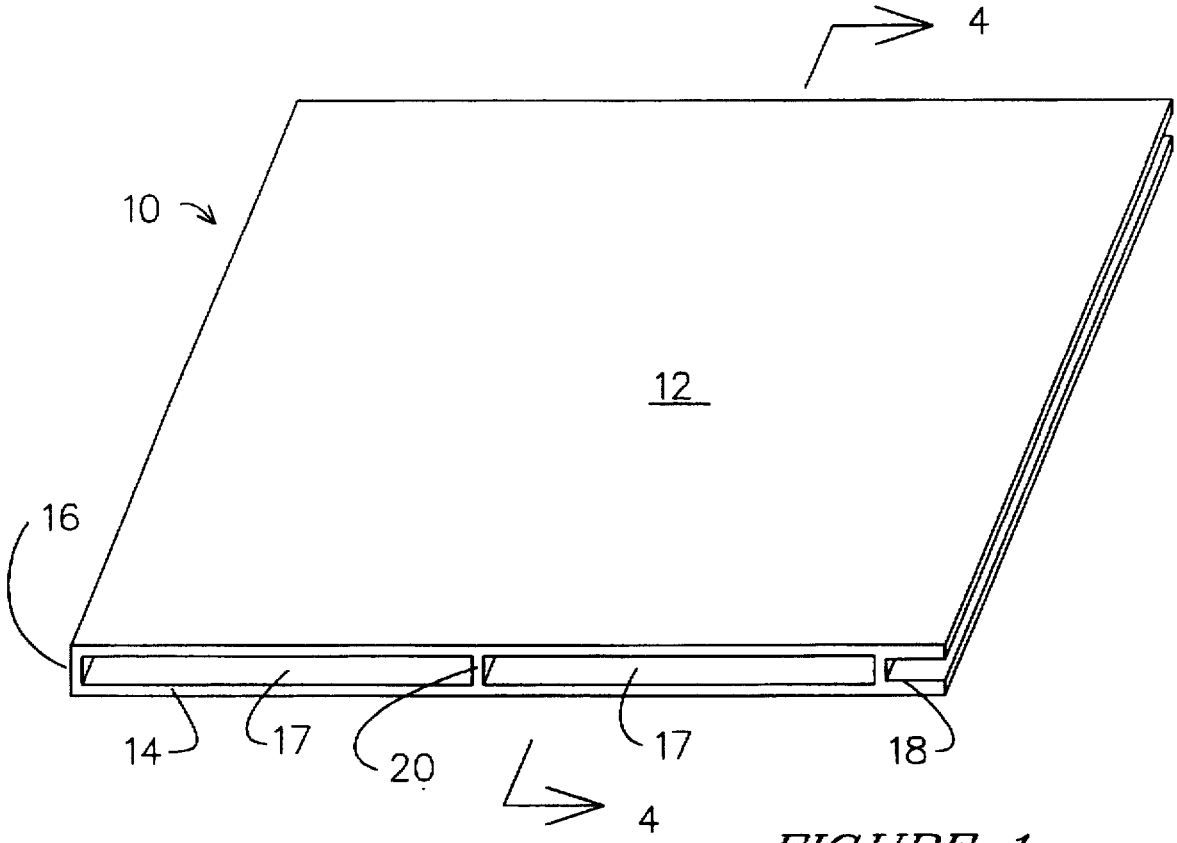
FIG. 1 is a perspective view of a pultruded door panel in accordance with this invention.
Figure 2:
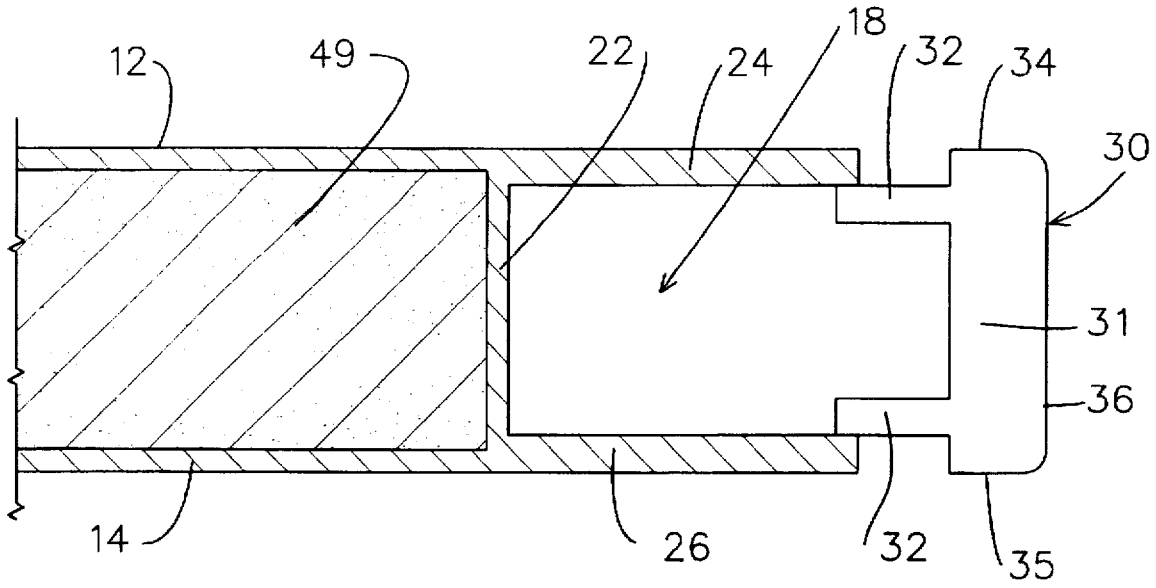
FIG. 2 is a partial sectional end view of the door panel of FIG. 1 showing the cooperation of a pultruded cap strip with the strike edge of the panel.
Figure 3:
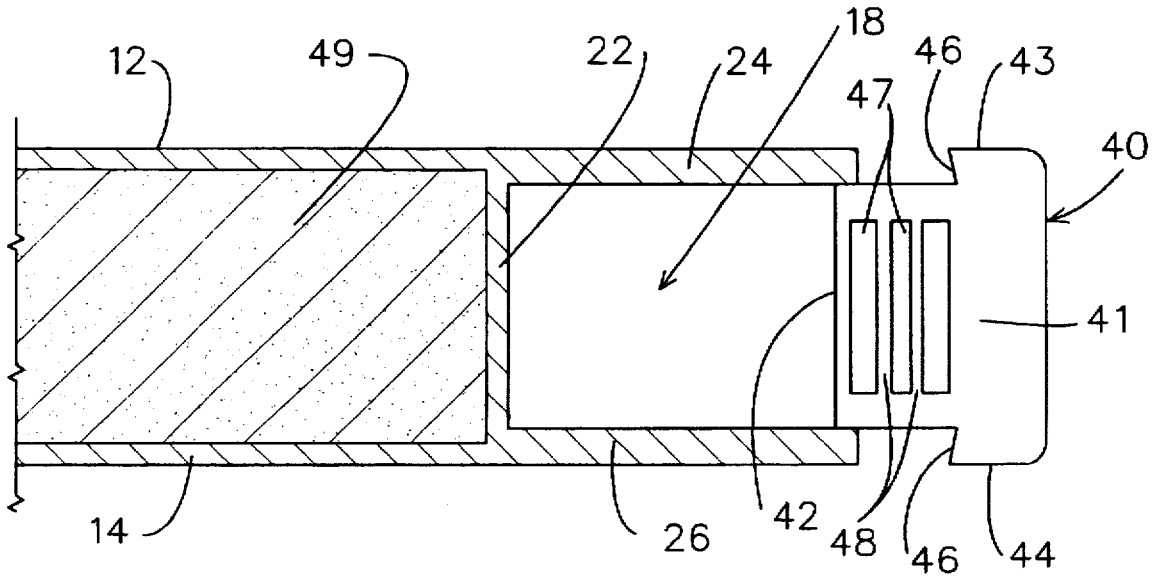
FIG. 3 illustrates the use of an extruded cap strip instead of the pultruded cap strip in the embodiment of FIG. 2.

A door panel made in accordance with this invention is indicated generally by the reference numeral 10 in FIG. 1. The panel 10 is of unitary construction and regular cross section. That is, a section taken perpendicular to the stile members at any point along the length of the panel will be the same. The panel comprises an upper face sheet 12, a lower face sheet 14, a hinge side stile member 16, and a strike side stile in the form of structural channel 18. The face sheets are spaced a selected distance apart by the stiles to provide the desired door thickness. One or more pillars 20 may optionally be disposed between stile 16 and channel 18 to provide added rigidity to the door panel. Pillar 20 is a continuously extending, wall-like member connecting the upper and lower face sheets. Channel 18, which forms the strike side stile and shown in greater detail in FIGS. 2 and 3, is an outwardly opening, three sided rectangle in shape and includes a continuously extending, channel base member 22 that reaches between the two face sheets. An upper and a lower channel wall, 24 and 26 respectively, extend parallel one with the other outwardly and at right angles to base member 22. Upper channel wall 24 comprises a thickened continuation of upper face sheet 12, and lower channel wall 26 comprises a thickened continuation of lower face sheet 14. Ordinarily, the channel walls will be at least twice, and up to three times or more, the thickness of the face sheets. With door panels that are designed for general interior use, the face sheets will typically be about ⅛ inch in thickness, and the channel walls then will range from about ¼ inch to ⅜ inch in thickness. The length of the channel walls 24 and 26 must be sufficient to allow a portion of the walls to be removed by trimming, so as to fit an out of specification frame and to support a latch mechanism or lock set. While the channel wall length is not critical, it normally is set between 2 and 3 inches.

The finished door panel requires that there be a second component part to the lock side panel edge, and that is a cap strip 30. Cap strip 30 is formed with a base 31 having a pair of projecting legs 32 extending perpendicularly to the base, and spaced such that the legs engagingly fit inside walls 24 and 26 of channel 18. Base 31 of cap strip 30 is dimensioned such that, when it is in place within channel 18, upper base end 34 effectively forms an uninterrupted extension of upper channel wall 24. Likewise, lower base end 35 will form an uninterrupted extension of lower channel wall 26. Thus, when the cap strip 30 is pressed into channel 18, there is only a thin seam line between the edge of the door and the edge of the placed cap strip.

The base edge 36 of cap strip 30 is sufficiently massive, suitably about ½ inch in thickness, so that when it and the edge of the door are bonded together, it will provide sufficient strength at the door panel edge to meet the performance standards required of a soundly constructed door panel. A strong structural lock edge, one that is capable of withstanding extensive lateral shock and abuse, is a desirable feature of a door panel. It is the strike, or lock, stile of the door that takes the shock and abuse (along with the frame) as a door is slammed. It is also this edge that must withstand the prying and pushing that often accompanies an attempted forced entry. Although a frictional fit between legs of the cap strip and the channel wall members can hold the cap strip in place, it is preferred that the two be bonded together. Bonding of the base edge to the channel may be accomplished using a suitable adhesive. Base edge 36 is preferably colored and textured to match the external surface of the face sheets 12 and 14.

Cap strip 30 is designed to be manufactured from pultruded fiber reinforced plastic. A pultruded cap is preferred for use in those installations in which heavy or abusive operating conditions use or temperature extremes are expected. FIG. 3 illustrates an alternative kind of cap strip 40 that is arranged to be manufactured from plastic by extrusion techniques. That cap would find especial use in those installations in which abusive use and temperature extremes are not overriding considerations. Also, an extruded cap strip is more flexible than is a pultruded one, and so can more easily accommodate a severe degree of panel alteration than can the pultruded strip. Cap strip 40 includes a base 41 and a box-like, inner body section 42, which may be formed with one or more cavities 47 and support members 48 to obtain an optimum ratio of strength to mass. Body section 42 is dimensioned such that it engagingly fits within channel 18. As with cap strip 30, the base 41 of cap strip 40 is dimensioned such that when body section 42 is emplaced within channel 18, the upper base end 43 forms an uninterrupted extension of upper channel wall 24. Likewise, lower base end 44 forms an uninterrupted extension of lower channel wall 26. The inner lip 46 of body section 42 may be chamfered or beveled to obtain a tighter fit with the end of the channel walls.

The door panel itself can be made in any desired width, and in preferred embodiments, is made in a number of widths to fit standardly dimensioned frames. The width of the door panel will not affect the performance or service offered. However, no matter the width, the strike or lock side stile will be in the shape of a heavy walled channel, as is detailed in FIGS. 2 and 3, and this channel will run the full length of the panel. Thus, whether a panel is 28 inches wide, or 35 inches wide, or 47 inches wide, or any metric approximations or dimensions required by a customer or market, it will receive the same lock, or strike, side stile treatment.

Channel 18 is key to the alterability potential of the door panel. A door panel will only function as a door when it is attached to a frame by hinges of some sort. Thus, it is the hinge stile that transfers the weight and strains of the door panel to the door frame, and thence to a structure wall. Further, if the hinges are not properly aligned, either the door panel will not swing in a proper arc, or the panel will be required to undergo torque to compensate for the misaligned hinges. On the other hand, the strike side stile usually has only one point that makes contact with the frame, and that is through the lock set's strike. Hence, it can now be appreciated that, if dimensional alterations to the door need to be made, they are most easily made on the lock side.

When a door panel of this invention needs to be altered for width, it is the walls 24 and 26 of channel 18 that are modified. A typical alteration procedure would be as follows. Upon determining that a door panel needs to be so altered, an installer would place the panel in a secure clamp, and would ascertain the reduced width of the panel allowing for the width, typically about ½ inch, added by the cap strip 30 or 40. For purposes of example, presume that the frame opening width is found to be 36 inches at the top of the doorway and 34¼ inches at the bottom. It is found that only the strike side leg of the frame is out of true, and the hinge side is square and perpendicular. Allowing for a clearance of ⅛ inch between the sides and top of the finished door panel (an accepted norm for non-beveled door panels), the panel width including the cap strip must then be 35¾ inches wide at the top and 34½ inches at the bottom. Assuming a ½ inch width for the cap strip base, the dimensions of the panel itself measured from the hinge stile to the outer edge of channel 18, will be 35¼ inches wide at the top and 34 inches at the bottom. A suitable saw is then used to trim the walls of channel 18 to the required size. When the cap strip is then bonded into place the altered, non-square strike stile edge is correctly dimensioned to fit with the out-of-square frame.

The door panel of this invention can most advantageously be manufactured in a continuous strip by pultrusion techniques. The strip is thereafter cut to the desired length of an individual panel. That method of manufacture is preferred, but the invention is not limited to a specific manufacturing technique. The door panels of this invention may also be fabricated using other traditional fabrication techniques. Including pultrusion, there are four principal methods that can be used for manufacturing fiberglass door panels. In a first approach, the component parts of a door are all fabricated from unprocessed resins and various configurations of glass fiber mats and strands. That technique is known as a hand lay-up process. A second technique, known as the resin transfer method, requires the use of molds that allow the fabricator to set all of the structural reinforcements for a panel into a hollow mold. The inside surface of the mold establishes the outer dimensions and surface finish of the panel. When the mold is closed and sealed a modified resin is injected into the mold, filling all of the mold cavities. There results a panel which is a truly unitary structure. In a third commonly used method, a fabricator will purchase or manufacture suitable component parts including face sheets, stiles, and top and bottom rails. The component parts are then bonded together to form a door that is referred to as being of composite construction.

The last, and preferred, manufacturing technique is pultrusion. As the name implies, pultrusion is a process by which a mixture of reinforcing fibers and resin is pulled through a carefully configured set of consecutive dies. The resulting structural shape is strengthened and stiffened by the reinforcing fibers which become aligned in a generally parallel relationship as they pass through the dies. Any relatively high aspect ratio fibrous reinforcing material that is compatible with the resin may be used in the pultrusion process. Commonly used reinforcing materials include fibers of glass, carbon and Kevlar. Glass fibers are generally preferred because of their combination of desirable physical properties and low cost.

The pultruded door panels of this invention are of totally unitary construction and of regular cross section. One or more cavities of regular cross section extend the length of the door panels. These cavities, indicated as numeral 17 of FIG. 1, are broadly bounded by hinge side stile member 16, top and bottom face sheets 12 and 14, and by the base member 22 of channel 18. Pillars 20, if present, divide the larger cavity area into two or more smaller cavities, each of regular cross section and preferably of generally equal area. It is generally preferred to fill those cavities with a core material 49 (FIGS. 2 and 3) that will contribute to the structural or operational characteristics of the door panel, or respond to a traffic, performance or environmental need. Selection of a particular core material is dictated by the operating requirements set for the panel. Among the core materials that can be used to fill the door panel cavities are paper, metal or plastic honeycomb, fibrous insulating material such as glass wool, foamed plastics such as foamed in place polyurethane, fire resistant materials such as foamed concrete, gypsum, and mineral boards, penetration resistant materials such as metal sheets, lead foil and sheets for X ray shielding, and bullet resistant shields made from Kevlar and similar materials. No matter what the core material used, the exterior appearance of the door panel will remain unchanged.

Figure 4:
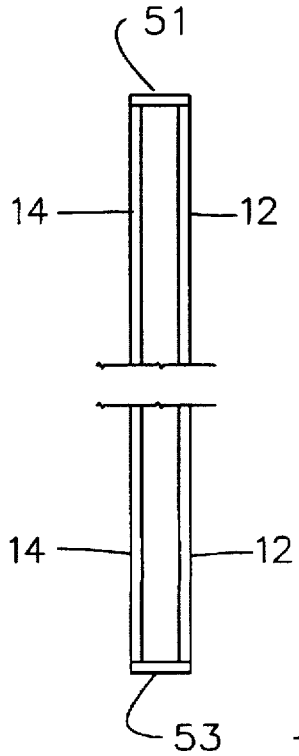
FIG. 4 is a sectional view taken along the line 4—4 of FIG. 1.

Turning now to FIG. 4, there is shown a sectional view of a finished door taken along line 4—4 of FIG. 1. The top and bottom of a door panel can be finished and sealed using a pair of thin end strips 51 and 53 respectively that may be adhesively bonded to the top and the bottom of the door and thereby completely seal the interior door cavity from any exterior contamination. If the door panel requires shortening in order to fit the frame, then either the top or the bottom of the door panel, or both, may be cut to suit the needs of the installation and the end strips bonded to the door after alteration. Optionally, rather than using end strips 51 and 53, the top and bottom of the altered door may be sealed with a quick-set polymer paste/adhesive. This last method works best with those door panels which have the internal panel cavities filled with a foamed material.

As may now be appreciated, this invention provides a door panel that is structurally sound and economical to manufacture. At the same time, the panel construction allows field alteration of the panel without compromising the performance features associated with door panels constructed of all fiber glass reinforced plastic. Further, should there be a need to supply door panels that use other materials for reinforcement other than glass fiber to meet exotic performance requirements for example, then this invention adds to the performance and desirability of those doors by still including those features normally associated with the glass reinforced door panel.

The embodiments of the invention in which exclusive rights are asserted are set out in the following claims.

I claim:

1. A method for making a door panel that is field alterable to fit an out-of-square or out-of-plumb frame comprising:

pultruding a continuous length of panel, said panel having a hinge side stile, a strike side stile, and a pair of face sheets, the stiles disposed parallel one to the other, the face sheets spaced apart by the stiles to define a cavity, the strike side stile comprising a channel in the shape of a three sided rectangle open to a side of the panel and extending continuously for the length of the panel, said channel having a base member and two channel walls, said base member extending between and disposed perpendicularly to said panel face sheets, said channel walls formed as extensions of said face sheets and having a thickness at least twice that of the face sheets; and cutting the pultruded panel to lengths equal to the desired height of a door panel.

2. The method of claim 1 including filling said cavity with a core material.

3. The method of claim 2 wherein said core material is selected from the group consisting of honeycomb, fibrous insulating materials, foamed plastics, fire resistant materials, X ray shielding materials, and penetration resistant materials.

4. The method of claim 1 wherein the depth of said channel is substantially less than the panel width.

5. The method of claim 1 wherein said channel walls are at least twice the thickness of said face sheets.

6. The method of claim 1 wherein at least one pillar is disposed within said cavity, the pillar comprising a continuously extending wall member disposed parallel to said stiles and connecting the two face sheets.

* * * * *